US010766675B2

(12) United States Patent
Yajko

(10) Patent No.: US 10,766,675 B2
(45) Date of Patent: Sep. 8, 2020

(54) CATALYST CONTAINER

(71) Applicant: SWIMC LLC, Cleveland, OH (US)

(72) Inventor: Michael Paul Yajko, Peninsula, OH (US)

(73) Assignee: SWIMC LLC, Cleveland, OH (US)

( * ) Notice: Subject to any disclaimer, the term of this patent is extended or adjusted under 35 U.S.C. 154(b) by 90 days.

(21) Appl. No.: 16/182,882

(22) Filed: Nov. 7, 2018

(65) Prior Publication Data

US 2019/0135510 A1 May 9, 2019

Related U.S. Application Data

(60) Provisional application No. 62/582,674, filed on Nov. 7, 2017.

(51) Int. Cl.

| | |
|---|---|
| ***B65D 51/28*** | (2006.01) |
| ***B65D 51/24*** | (2006.01) |
| ***B65D 43/02*** | (2006.01) |
| ***B65D 53/02*** | (2006.01) |
| ***B65D 47/12*** | (2006.01) |
| ***B65D 25/44*** | (2006.01) |

(52) U.S. Cl.

CPC ..... *B65D 51/2885* (2013.01); *B65D 25/44* (2013.01); *B65D 43/0208* (2013.01); *B65D 47/128* (2013.01); *B65D 51/242* (2013.01); *B65D 53/02* (2013.01); *B65D 2251/02* (2013.01)

(58) Field of Classification Search

USPC ..... 206/219, 220, 221, 222, 524.1, 524.4

See application file for complete search history.

(56) References Cited

U.S. PATENT DOCUMENTS

| | | | | |
|---|---|---|---|---|
| 1,881,772 A | | 10/1932 | Gallogly | |
| 3,718,235 A | * | 2/1973 | Cronan | B65D 81/3222 222/136 |
| 4,971,193 A | * | 11/1990 | Groves | B65D 81/3211 206/219 |

(Continued)

OTHER PUBLICATIONS

Amazon. House of Kolor Kosmic Color Urethane Enamel Catalyst (Pint). Aug. 2, 2013. https://www.amazon.com/House-Kosmic-Urethane-Enamel-Catalyst/dp/B003TQTDR8 (Year: 2013).

(Continued)

*Primary Examiner* — Jacob K Ackun

(74) *Attorney, Agent, or Firm* — Tucker Ellis, LLP; Patrick Clunk; Carlos Garritano

(57) ABSTRACT

Provided is a container assembly including a storage container and a catalyst container. The catalyst container includes a reservoir for holding a second material, such as a reactive hardener or activator as used in 2K coating systems, or a catalyst, the reservoir having a spacer extending therefrom, and a top member removably secured to the reservoir. The top member is secured to a spout of the storage container and is movable with the spout. The spout of the storage container is movable from a closed position to an open position thereby moving the top member away from the reservoir and separating the reservoir from the top member, which causes the reservoir to drop into the storage container to mix the catalyst with a material in the storage container.

20 Claims, 19 Drawing Sheets

(56) References Cited

U.S. PATENT DOCUMENTS

| | | | | |
|---|---|---|---|---|
| 5,971,140 | A * | 10/1999 | Frutin | B65D 83/386 206/222 |
| 6,022,134 | A * | 2/2000 | Andrews | B01F 13/002 206/221 |
| 6,843,368 | B1 * | 1/2005 | Frutin | B65D 51/2857 206/219 |
| 7,055,684 | B2 * | 6/2006 | Anderson | B65D 51/2842 206/219 |
| D564,881 | S | 3/2008 | Chupak | |
| D596,486 | S | 7/2009 | Pearsall | |
| 8,215,481 | B1 * | 7/2012 | Knickerbocker | B65D 51/285 206/222 |
| D676,328 | S | 2/2013 | Yourist | |
| D682,095 | S | 5/2013 | Cohen et al. | |
| D727,737 | S | 4/2015 | Damashek | |
| D825,273 | S | 8/2018 | Liming et al. | |
| 10,315,830 | B2 | 6/2019 | Muhlemann | |
| 2004/0112770 | A1 | 6/2004 | Oswald | |
| 2012/0273509 | A1 | 11/2012 | Yao | |

OTHER PUBLICATIONS

PCT/US2018/059559; International Preliminary Report on Patentability; dated May 12, 2020; 7 pages.

* cited by examiner

CATALYST CONTAINER

PRIOR APPLICATIONS

This application claims priority to and the benefit of U.S. Provisional Application Ser. No. 62/582,674 filed on Nov. 7, 2017, the entirety of which is incorporated herein by reference.

BACKGROUND

Coating materials (e.g., paints, stains, varnishes, chemicals, etc.) can be stored is a metal container having a metal removable lid or metal top that is not removable. The lid or top can include a spout to allow the coating material to be removed from the container.

TECHNICAL FIELD

Embodiments of the subject matter disclosed herein relate to a storage container, and more particularly a catalyst container used with a storage container for a coating material. As used herein, the catalyst container of the invention is a reservoir that is attachable to or integrally molded with the lid of a storage container to house a second material intended to react with the material in the storage container, such as a reactive hardener or activator as used in 2K coating systems, or a catalyst. As used herein, a catalyst shall be intended to mean a second material, such as a reactive hardener or activator as used in 2K coating systems, or a catalyst.

BRIEF DESCRIPTION

In an embodiment, a container assembly is provided that includes a storage container including a container body defining a first chamber for holding a first material, and a lid assembly including a lid removably or nonremovably secured to the container body and a first spout secured to the lid and defining a through passage in communication with the first chamber, and a catalyst container including a reservoir defining a second chamber for holding a second material, the reservoir having a spacer extending therefrom, and a top member removably secured to the reservoir to close the second chamber, the top member having a second spout secured to the first spout and defining a through passage in communication with the through passage of the first spout, wherein the first spout is movable between a closed position and an open position, wherein when the first spout is in the closed position, the spacer abuts an underside of the lid or an underside of the first spout and the top member is attached to the reservoir, and wherein when the first spout is in the open position , the top member is moved away from and separated from the reservoir causing the reservoir to drop into the first chamber causing the second material to mix with the first material.

In another embodiment, a container assembly is provided that includes a storage container including a container body defining a first chamber for holding a coating material, and a lid assembly including a lid removably or nonremovably secured to the container body and a first spout secured to the lid, and a catalyst container including a reservoir defining a second chamber for holding a second material, such as a reactive hardener or activator as used in 2K coating systems, or a catalyst, the reservoir having a spacer extending therefrom for abutting the lid or first spout, and a top member removably secured to the reservoir, the top member having a second spout secured to the first spout of the lid assembly.

In still another embodiment, a method of catalyzing a coating material in a storage container is provided. The storage container includes a container body defining a first chamber and a lid assembly including a lid removably or nonremovably secured to the container body and a first spout secured to the lid, and a catalyst container including a reservoir defining a second chamber for holding a second material and a top member removably secured to the reservoir, the top member having a second spout secured to the first spout. The method includes moving the first spout from a closed position to an open position thereby moving the top member away from the reservoir and separating the reservoir from the top member, and mixing the catalyst with the coating material when the reservoir drops into the first chamber.

BRIEF DESCRIPTION OF THE DRAWINGS

Reference is made to the accompanying drawings in which particular embodiments and further benefits of the provided subject matter are illustrated as described in more detail in the description below.

DETAILED DESCRIPTION

Figure 1:
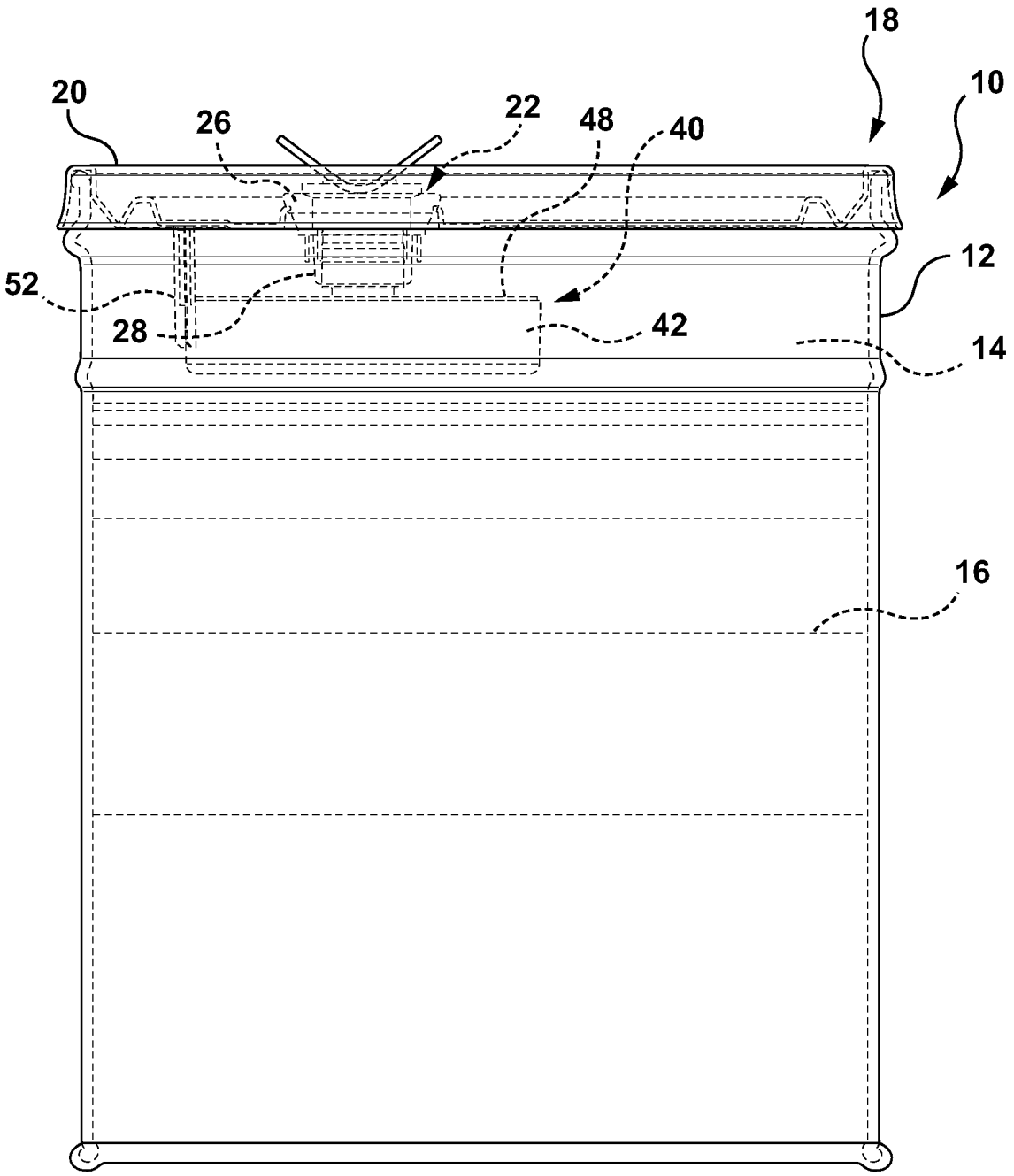
FIG. 1 is a perspective view of an embodiment of a storage container.

Embodiments of the provided subject matter relate to a catalyst container having a reservoir defining a chamber for holding a second material, such as a reactive hardener or activator as used in 2K coating systems, or a catalyst, and including a spacer arm, and a top member removably secured to the reservoir to close second chamber. The top member has a spout that secures to a spout of a storage container. The use of the catalyst container allows for increased shelf life of a coating material in the storage container verses coating materials that are premixed with a catalyst either during manufacture or in a store.

With reference to the drawings, like reference numerals designate identical or corresponding parts throughout the several views. However, the inclusion of like elements in different views does not mean a given embodiment necessarily includes such elements or that all embodiments of the invention include such elements.

Referring initially to FIGS. 1-6, a storage container is illustrated generally at reference numeral 10. The storage container 10 includes a container body 12 defining a first chamber 14 for holding a first material 16, such as a coating material, such as paint, stain, varnish, chemicals, such as epoxy resins or polyol resins, etc., and a lid assembly 18 secured to the container body 12. The lid assembly 18 includes a lid 20 removably secured to the container body 12 and a spout assembly 22 secured to the lid 20 and defining a through passage 24 in communication with the first chamber 14. The lid assembly 18 can be removably secured to the container body 12 as shown, such as, for example, with a five gallon coating container and may be sized to hold a suitable amount of a second material, such as a reactive hardener, activator, or catalyst (for example, in an amount of fifteen ounces) or the lid assembly can be nonremovably secured to or otherwise integrally formed with the container body, such as with a drum.

In the illustrated embodiment, the spout assembly 22 is a flexible spout assembly formed of a suitable material, such as plastic. The spout assembly 22 includes a body 26 secured to the lid 20, a first spout 28 extending from the body 26 and movable between a closed position shown in FIG. 3 and an open position shown in FIG. 4 and defining the through passage 24, and a cap 30 removably secured to the spout 28. The cap 30 may include one or more gripping device 32 for a user to grasp and pull to move the cap 30 and spout 28 upward away from the body 26 to the open position. In an embodiment, the cap 30 may be covered by a tamper resistant seal such that the cap 30 and thereby the spout 28 cannot be moved to the open position without removal of the tamper resistant seal. Additionally or alternatively, the spout 28 can be closed by a tamper resistant seal that is removed prior to pouring, spraying, or pumping coating material out of the spout 28. In an embodiment, the spout 22 may additionally include a plurality of circumferentially spaced fins 34 extending from the body 26. The fins 34 extend substantially parallel to a longitudinal axis of the first spout 28 in the closed position, and substantially perpendicular to the longitudinal axis in the open position. In another embodiment, the spout 22 does not include the fins 34. The spout can be sized and shaped to attach to an attachment, such as a spraying accessory or a pumping accessory.

Attached to the storage container is a catalyst container 40 shown in FIGS. 2-11. The catalyst container 40 includes a reservoir 42 defining a second chamber 44 for holding a second material 46 such as a catalyst, a top member 48 removably secured to the reservoir 42 to close the second chamber 44, and a seal 50, such as an 0-ring for sealing the top member 48 to the reservoir 42, which is disposed in a seal groove 58 in the top member 48. In an embodiment, the seal is not utilized. The catalyst container 40 may be formed of any suitable material, such as plastic, and may be formed in any suitable manner, such as molding.

The reservoir 42 includes one or more spacers or arms 52 extending upward from a top of the reservoir 42, which may be integrally formed with the reservoir 42 or attached thereto. The one or more spacers 52 may be curved to follow a curvature of an outer surface of the reservoir 42. The top member 48 includes a second spout 54 defining a through passage 56 in communication with the through passage 24 in the first spout 28 and extending upward from a substantially planar body 60. The second spout 54 extends upward from the planar body 60 substantially perpendicular to the body 60. The body 60 can have a lip 62 that contacts a top of the reservoir 42 when secured thereto, and an area defining the seal groove 58 that is disposed within the second chamber 44 when the top member 48 is secured to the reservoir 42.

The second spout 54 is designed to couple to the first spout 28 in a suitable manner, such as by a pressure fit, threaded connection, adhesive, molding, etc., and as shown is partially disposed within the first spout 28 such that the fluid can flow from the container body 12 through the through passage 56 in the second spout, through the through passage 24 in the first spout 28, and out of the first spout 28. The second spout 54 includes one or more circumferentially extending ribs 64 extending radially outward from an outer surface of the second spout 54 that abut an inner surface of the first spout 28 to create the pressure fit. The second spout 54 can be sized such that it abuts an inner surface of the first spout 28 so that the coating material 16 can be poured, sprayed, or pumped out of storage container 12 via the first spout 28 without obstruction. The second spout 54 can also be sized to include a reduced diameter portion 66 at a bottom of the spout 54. When the first spout 28 moves to the open position, the fins 34 move inward and surround the second spout 54 at the reduced diameter portion 66. The fins 34 assist in preventing disengagement of the second spout 54 from the first spout 28 in the open position. In the illustrated embodiment, the second spout 54 extends upward a first distance and the spacer 52 extends upward a second distance greater than the first distance such that the spacer 52 extends further from a bottom of the catalyst container 40 than the second spout 54.

Figure 2:
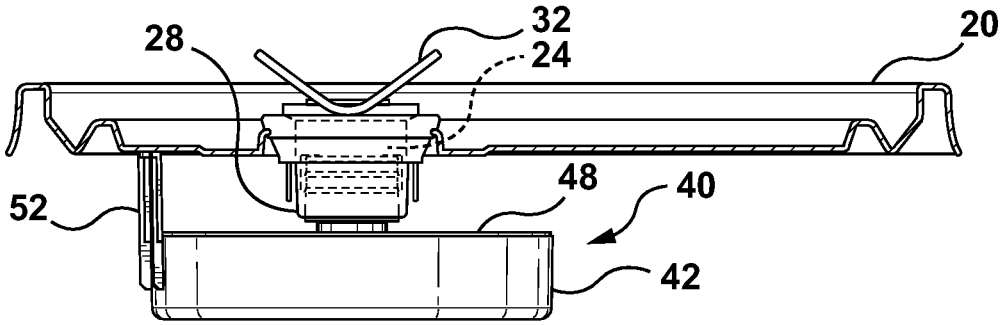
FIG. 2 is a cross-sectional view taken about line 2-2 in FIG. 1.
Figure 3:
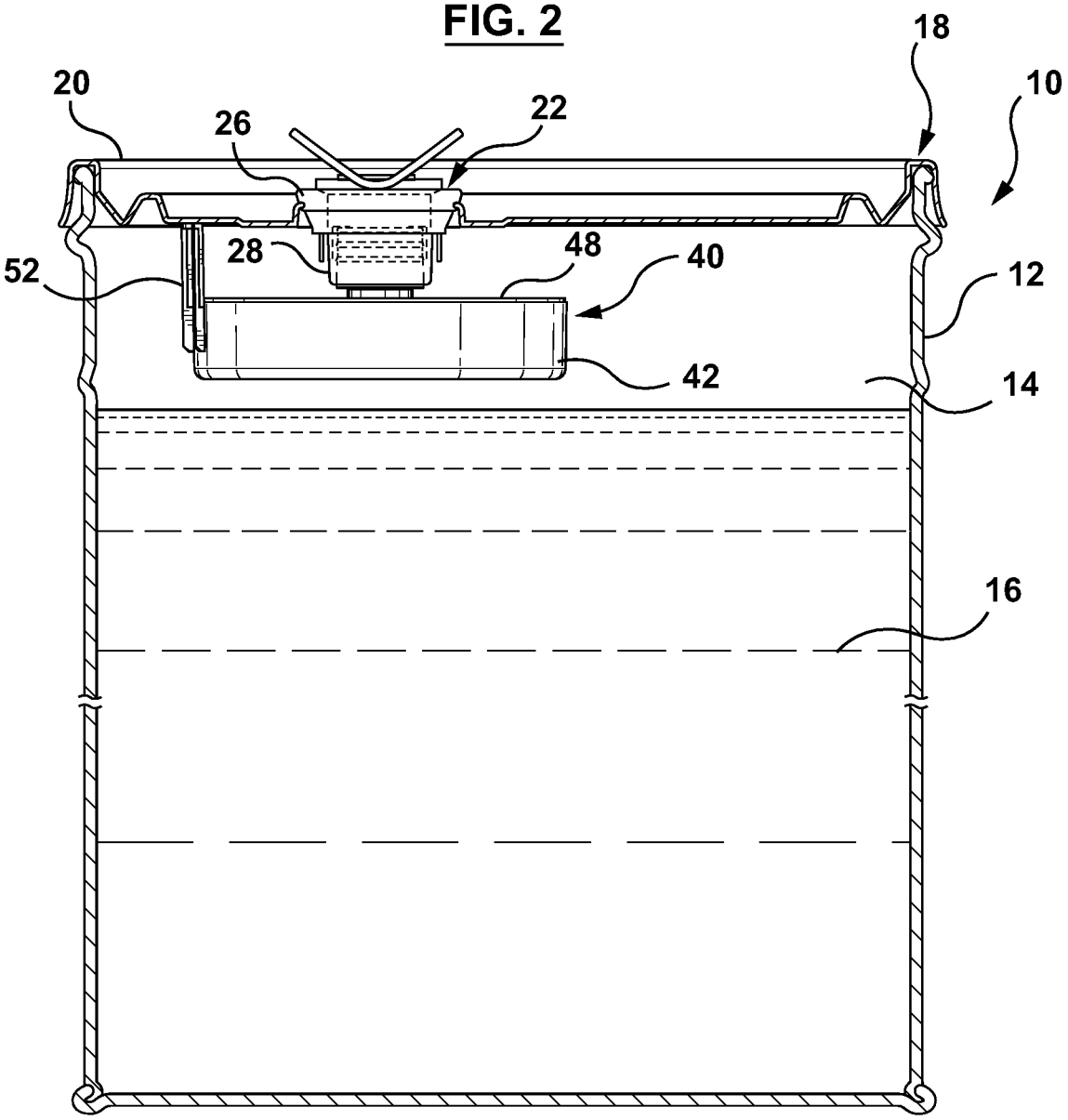
FIG. 3 is a cross-sectional view taken about line 3-3 in FIG. 1 showing a catalyst container in a first position.
Figure 4:
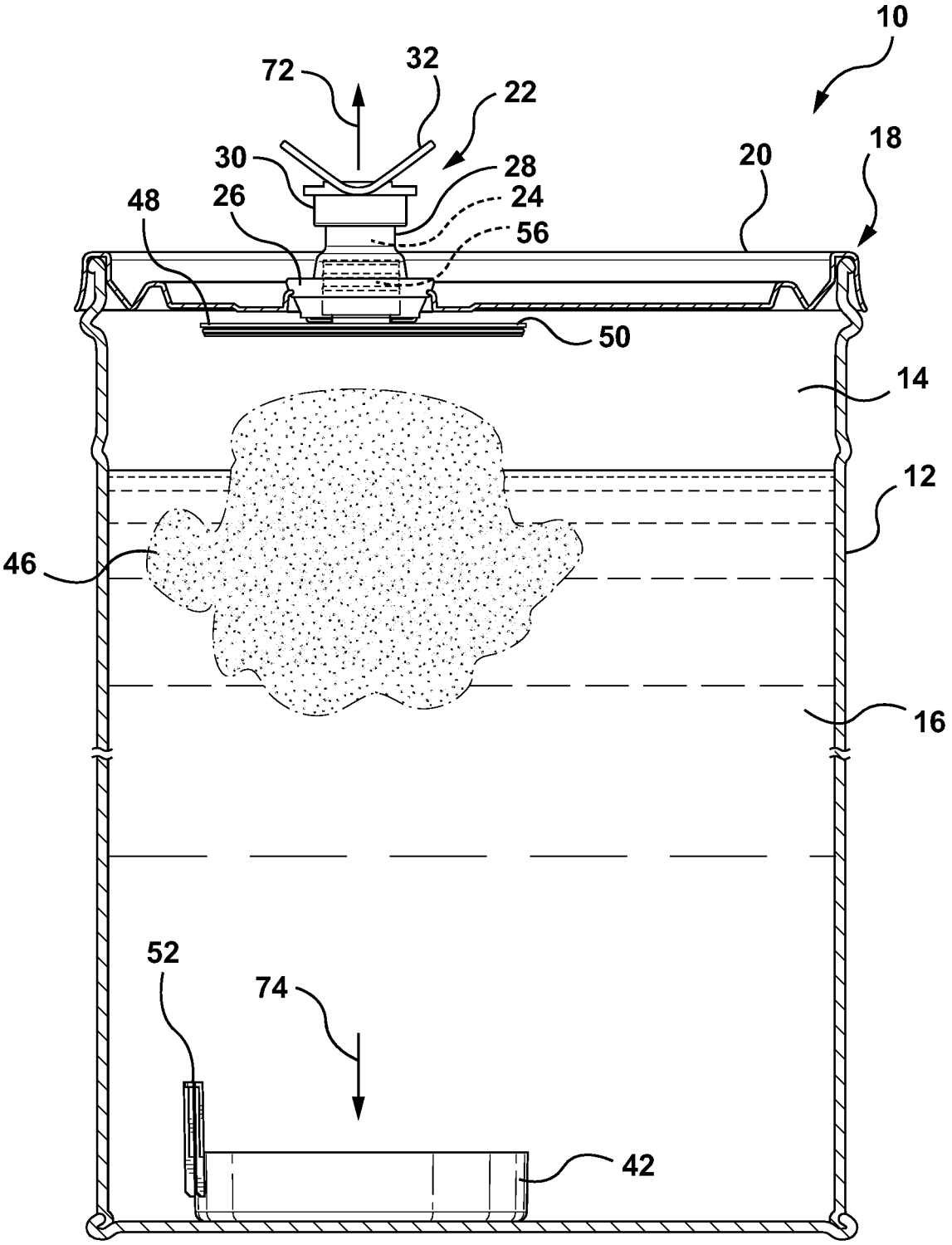
FIG. 4 is a cross-sectional view taken about line 4-4 in FIG. 1 showing the catalyst container in a second position.
Figure 5:
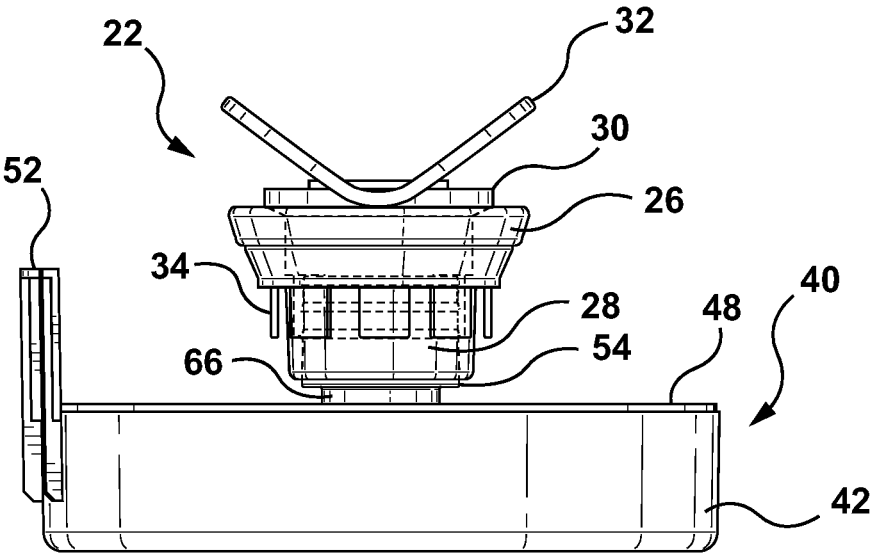
FIG. 5 is a left side view of the catalyst container attached to a spout of the storage container when the spout in a closed position.
Figure 6:
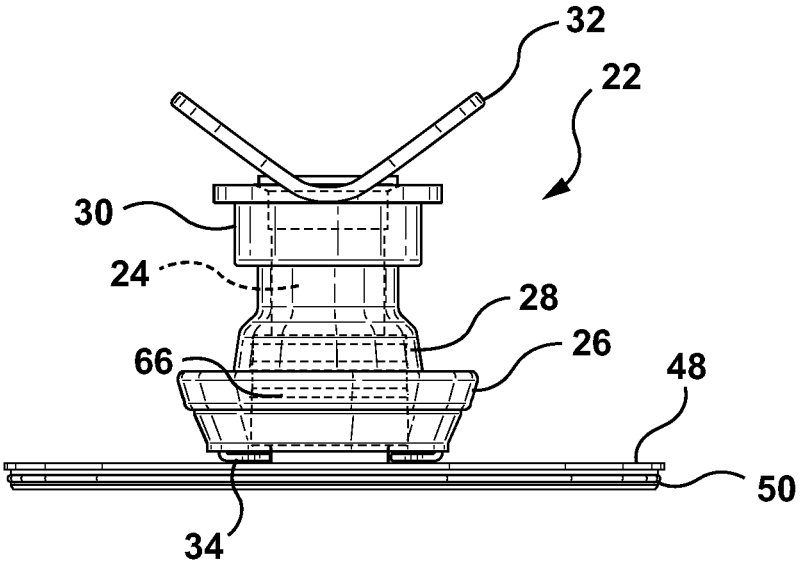
FIG. 6 is a left side view of a top member of the catalyst container attached to the spout when the spout is in an open position.
Figure 7:
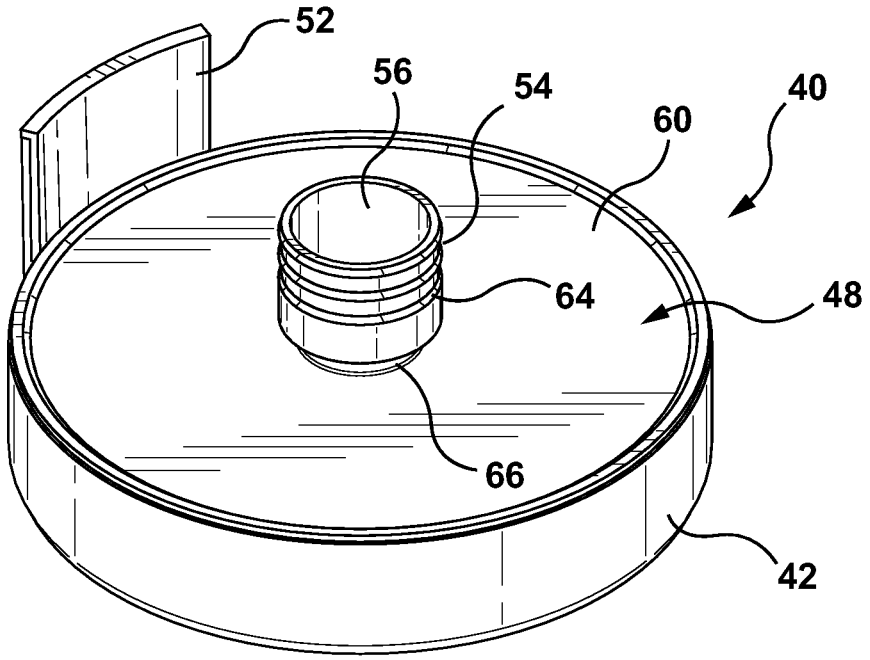
FIG. 7 is a perspective view of the catalyst container.
Figure 8:
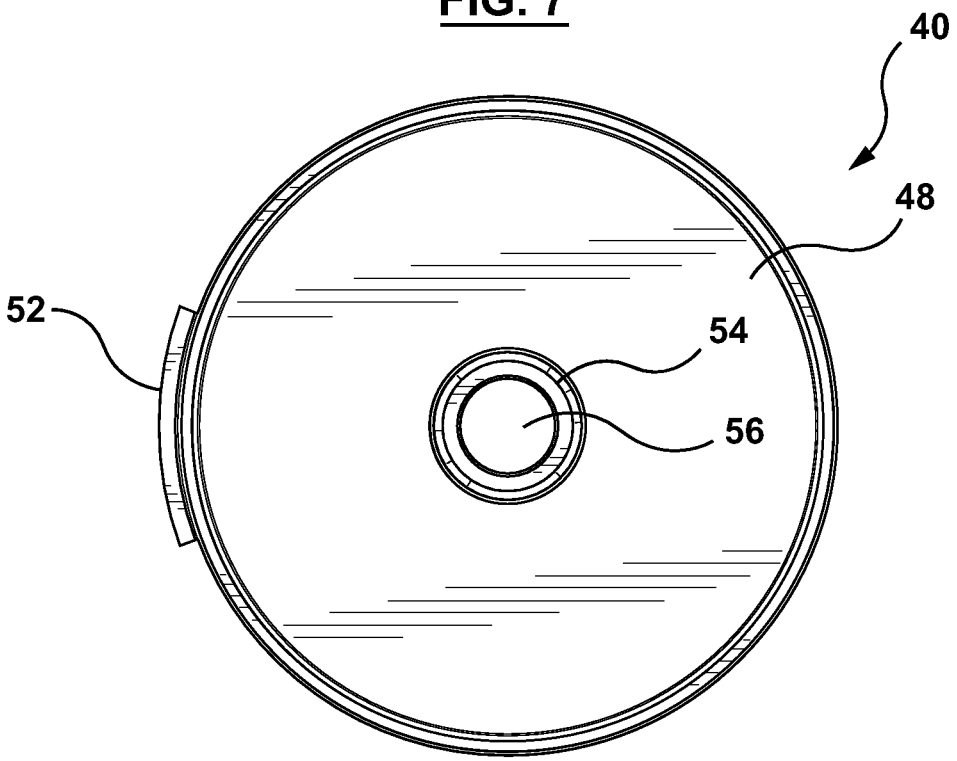
FIG. 8 is a top view of the catalyst container.
Figure 9:
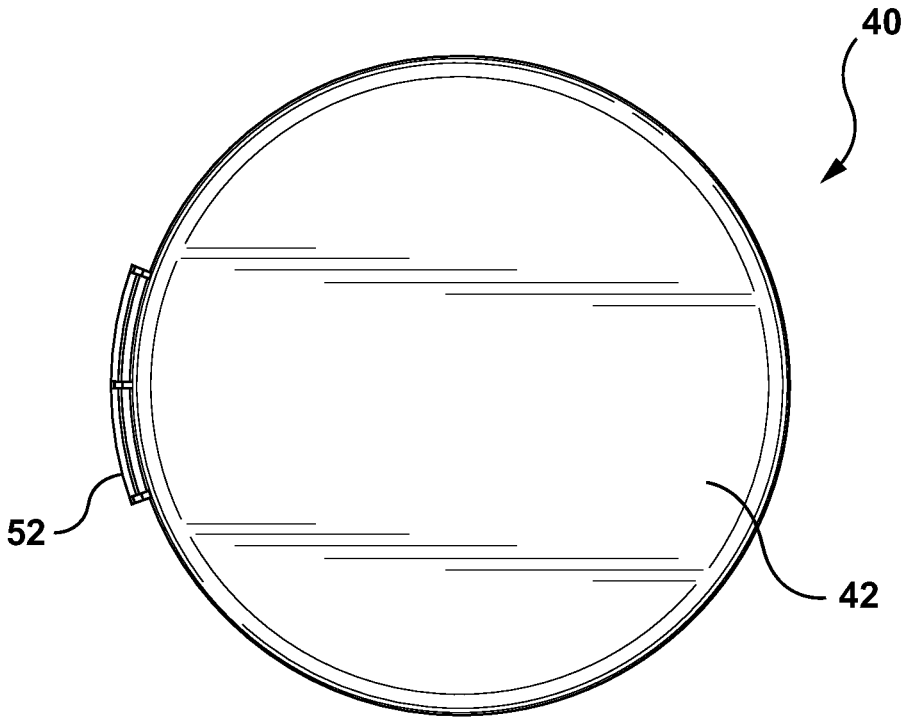
FIG. 9 is a bottom view of the catalyst container.
Figure 10:
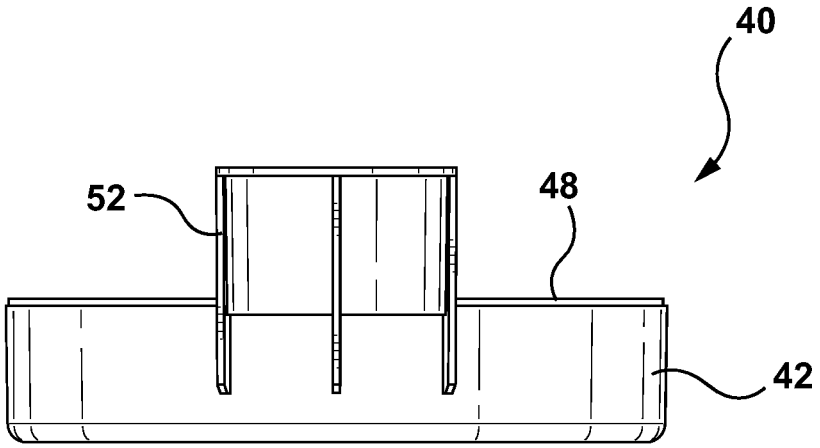
FIG. 10 is a rear view of the catalyst container.
Figure 11:
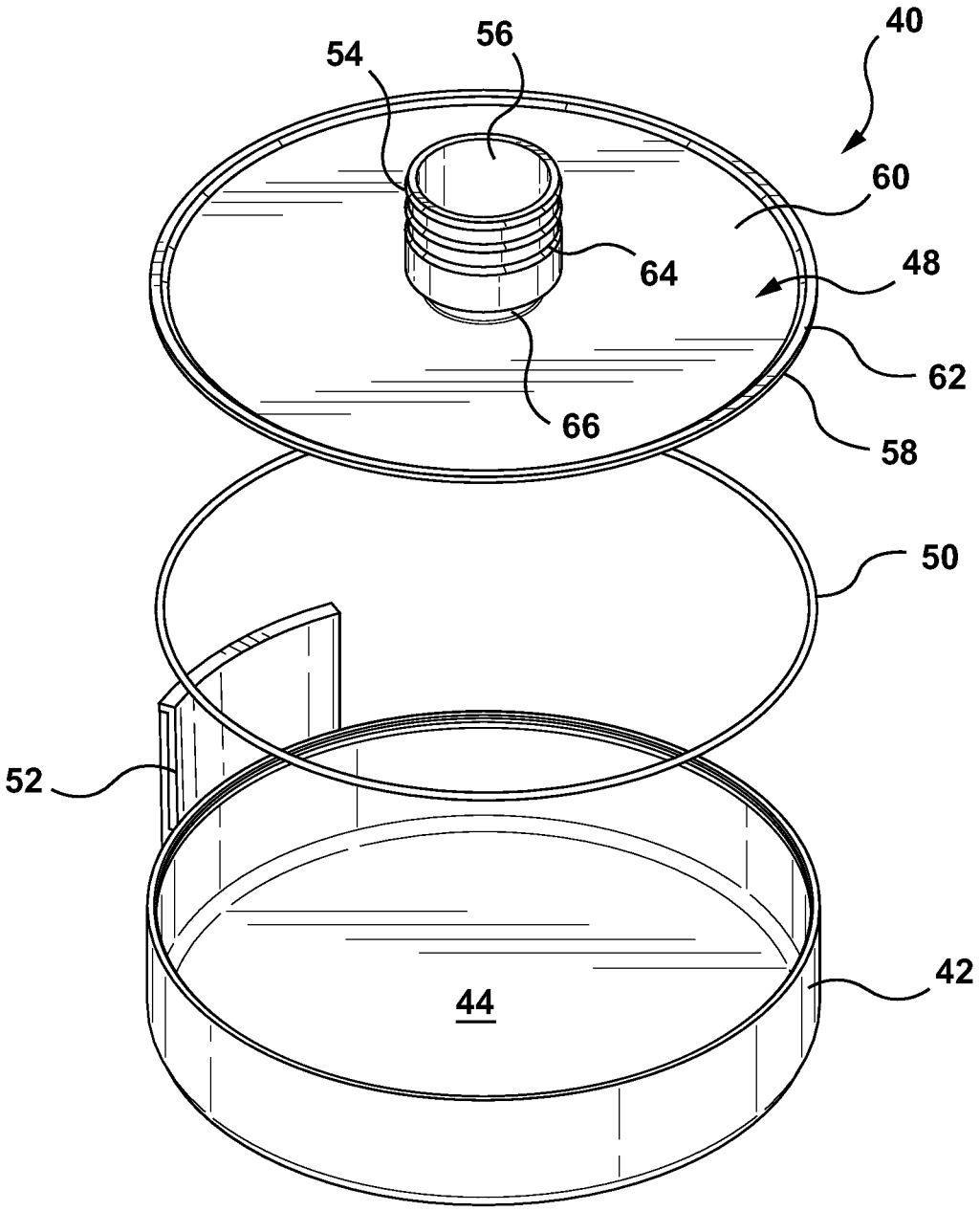
FIG. 11 is an exploded view of the catalyst container.
Figure 14:
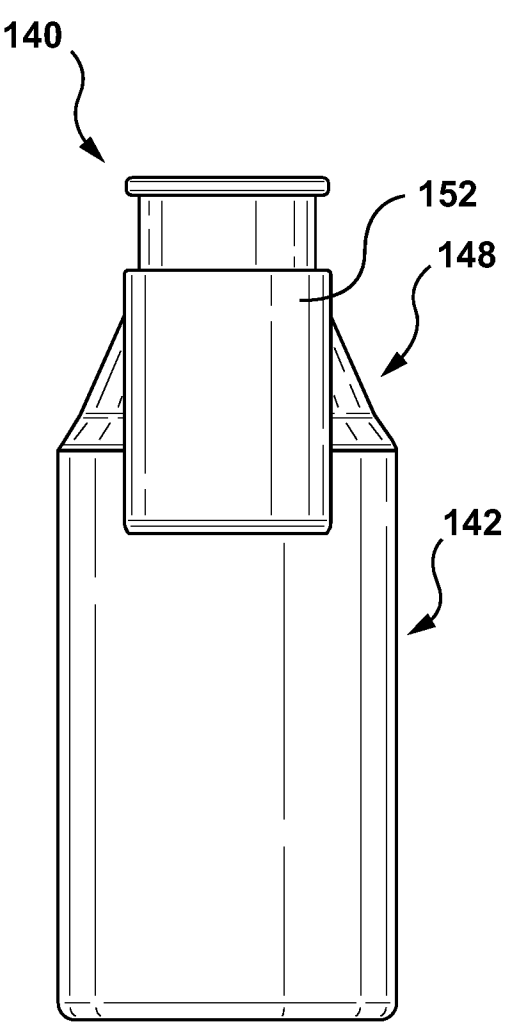
FIG. 14 is a rear view of the catalyst container.
Figure 13:
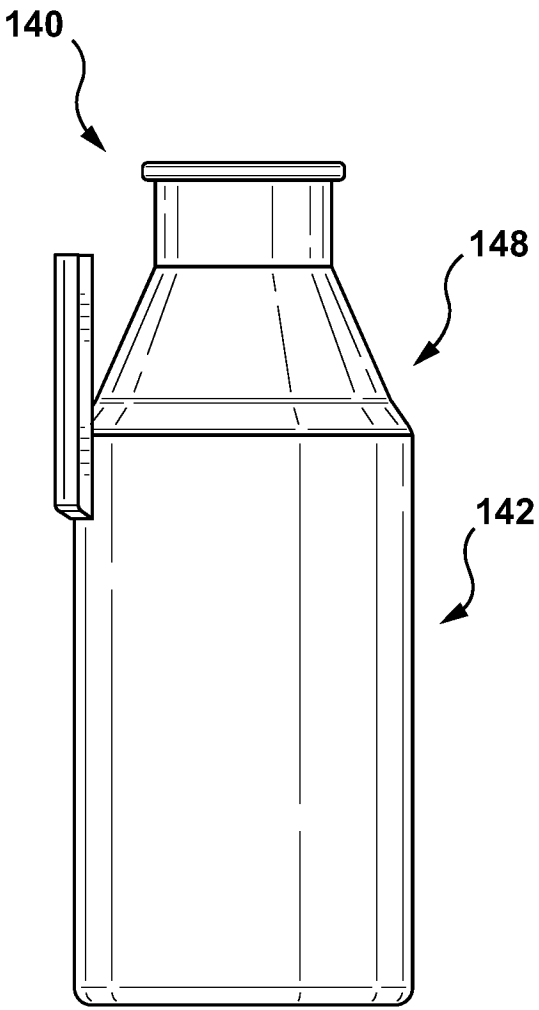
FIG. 13 is a left side view of the catalyst container.
Figure 12:
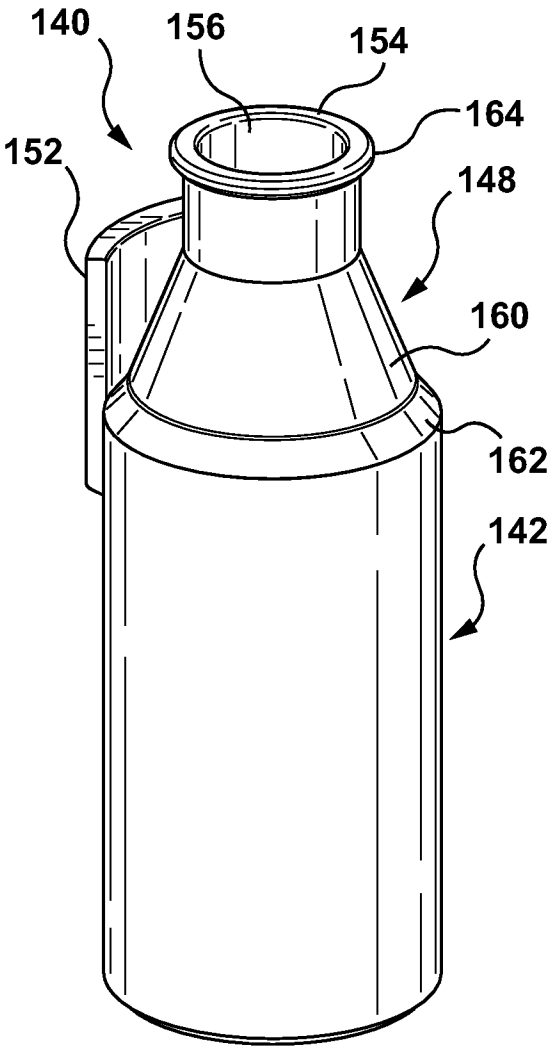
FIG. 12 is a perspective view of another embodiment of a catalyst container.
Figure 15:
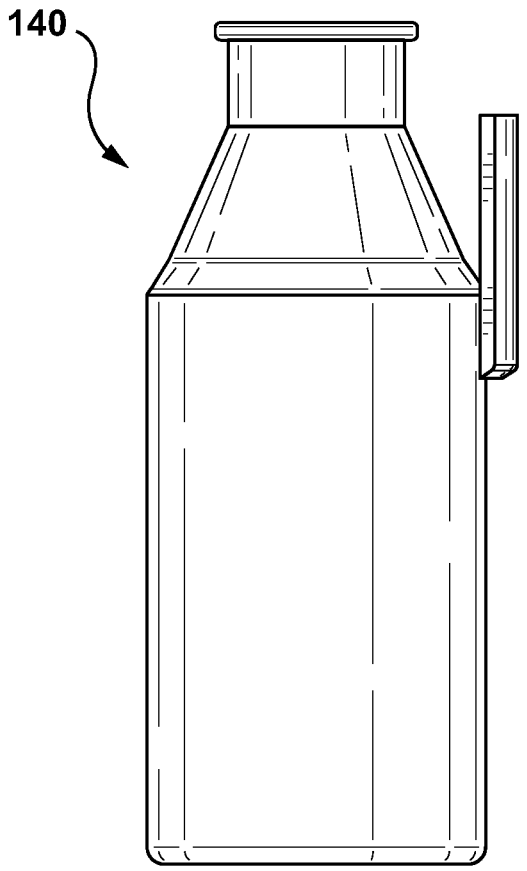
FIG. 15 is a right side view of the catalyst container.
Figure 16:
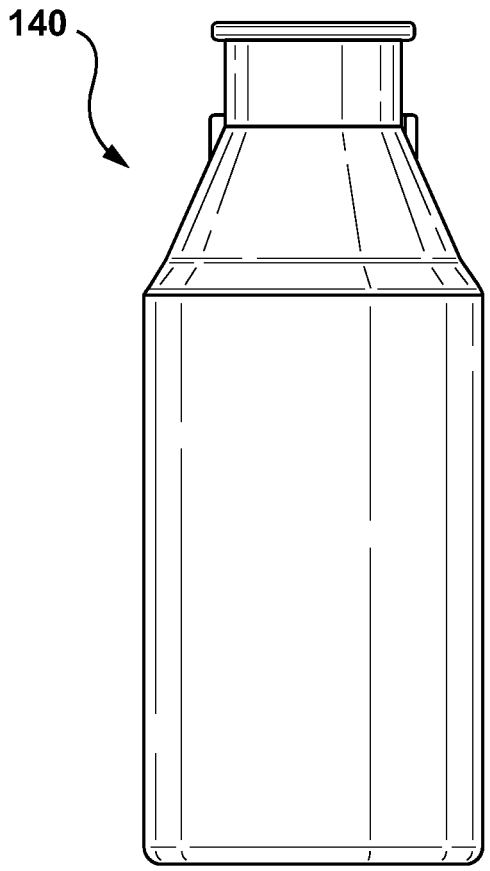
FIG. 16 is a front view of the catalyst container.
Figure 17:
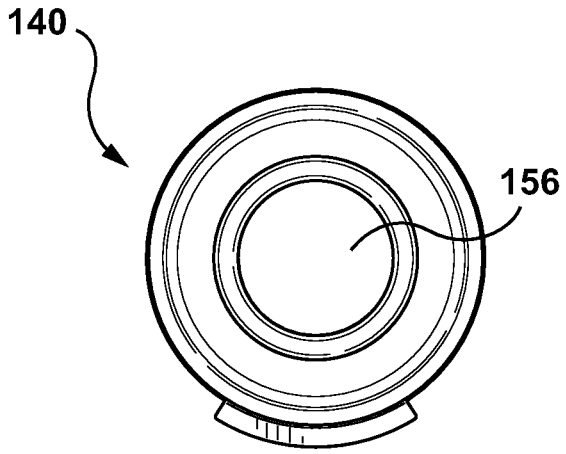
FIG. 17 is a top view of the catalyst container.
Figure 18:
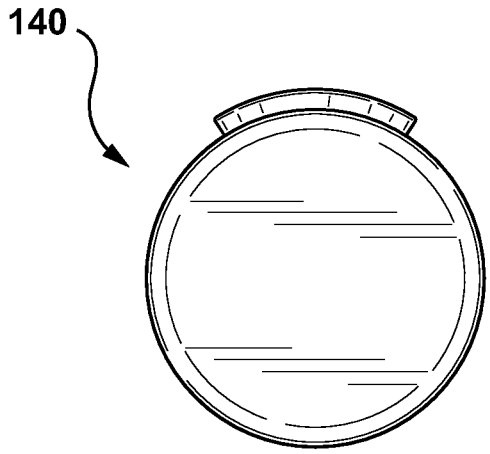
FIG. 18 is a bottom view of the catalyst container.

As shown in FIGS. 2 and 3, when the first spout 28 is in the closed position and the top member 48 is secured to the reservoir 42, a top of the spacer 52 abuts an underside of the lid 20 serving as a stop to prevent upward movement of the reservoir 42. In this position, the catalyst 46 is stored within the reservoir 42 to prevent mixing with the coating material until desired by a user, thereby increasing a shelf life of the coating material. As shown in FIG. 4, when the first spout 28 is moved to the open position, the top member 48 is moved upward with the first spout 28, while the spacer 52 prevents upward movement of the reservoir 42, and thereby the top member 48 is moved away from the reservoir 42 until the top member 48 separates from the reservoir 42.

When the top member 48 separates from the reservoir 42, the reservoir drops into the container body 12 causing the catalyst to mix with the coating material. The spacer 52 additionally serves to prevent the reservoir 42 from blocking the through passage 56 in the second spout 54 by preventing the top of the reservoir from coming into contact with the top member 48 when the first spout 28 is in the open position. In an embodiment, the reservoir 42 can be made of a material denser than the coating material 16 causing the reservoir 42 to sink to a bottom of the container body 12. In an embodiment, the reservoir 42 may include one or more magnets that magnetize to the bottom of the container body 12 to hold the reservoir 42 in position when the coating material 16 is poured, sprayed, or pumped out of the storage container 12. Additionally or alternatively, a top of the reservoir 42 can be denser than a bottom of the reservoir 42.

As noted above, when the storage container 10 is on a store shelf, an end user's shelf, etc., the first spout 28 is in the closed position and the reservoir 42 is secured to the top member 48, which is secured to the first spout 28, to prevent mixing of the catalyst 46 with the coating material 16 as shown in FIG. 3. The cap 30 optionally be can be covered by a tamper resistant seal to indicate to a user that the catalyst 46 has not been mixed with the coating material 16. When the end user want to use the coating material 16, the end user removes the tamper resistant seal. The end user then grasps the gripping devices 32 on the cap 30 and pulls upward away from the lid 20 in a first direction shown by the arrow 72 in FIG. 4 until the first spout 28 is in the open position. As the first spout 28 moves upward, the second spout 54 attached thereto moves upward with the first spout 28, thereby causing the reservoir 42, which is prevented from moving upward by the spacer 52, to separate from the top member 48. After separation of the top member 48 and the reservoir 42, the reservoir 42 moves downward away from the lid 20 in a second direction shown by the arrow 74 opposite the first direction toward the bottom of the storage container 12 causing the catalyst 46 to disperse in the coating material 16. The end user can then shake or otherwise agitate the coating material 16 to cause the catalyst 46 to mix with the coating material 16. The top member 48 remains attached to the first spout 28 during movement of the first spout 28 between the open and closed positions unless removed by the end user.

In this way, the catalyst 46 is released on demand without requiring the end user to come in contact with the catalyst container 40 and thereby avoids user contact with the catalyst 46.

Turning now to FIGS. 12-20, an exemplary embodiment of the catalyst container is shown at 140 and the spout assembly is shown at 122. The catalyst container 140 and spout assembly 122 are substantially the same as the above-referenced catalyst container 40 and spout assembly 22, and consequently the same reference numerals but indexed by 100 are used to denote structures corresponding to similar structures in the catalyst container and spout assembly. In addition, the foregoing description of the catalyst container 40 and spout assembly 22 is equally applicable to the catalyst container 140 and spout assembly 122 except as noted below.

Referring initially to FIGS. 12-18, the catalyst container 140 includes a reservoir 142 defining a second chamber for holding a catalyst, and a top member 148 removably secured to the reservoir 142 to close the second chamber. The catalyst container is shown without a seal between the top member 148 and the reservoir 142, although it will be appreciated that a seal may be used. The catalyst container 140 may be used with any suitable storage container, such as a one gallon container, and may be sized to hold a suitable amount of catalyst, such as three ounces.

The reservoir 142 includes one or more spacers or arms 152 extending upward from a top of the reservoir 142 and the top member 148 includes a second spout 154 defining a through passage 156 in communication with a through passage in a first spout of a container and extending upward from a conical body 160. The body 160 can have a lip 162 that contacts a top of the reservoir 142 when secured thereto, and an area having an annular rib 158 that is disposed within the second chamber when the top member 148 is secured to the reservoir 142 and that engages with an inner surface of the reservoir 142.

Figure 19:
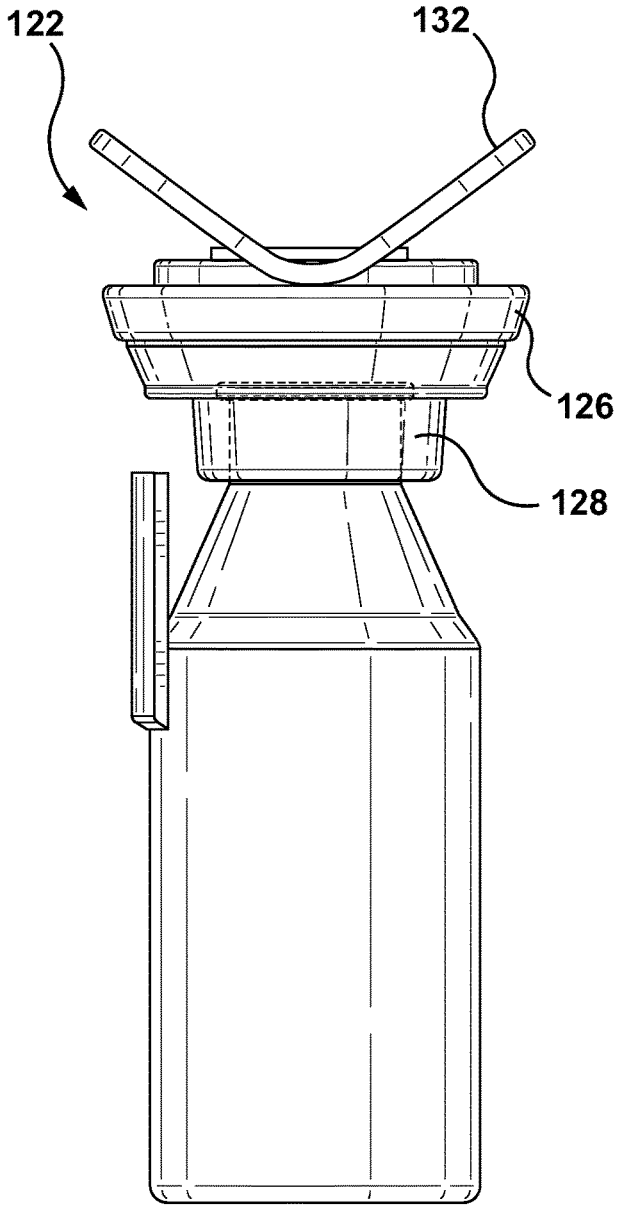
FIG. 19 is a left side view of the catalyst container of FIG. 12 attached to a spout assembly.
Figure 20:
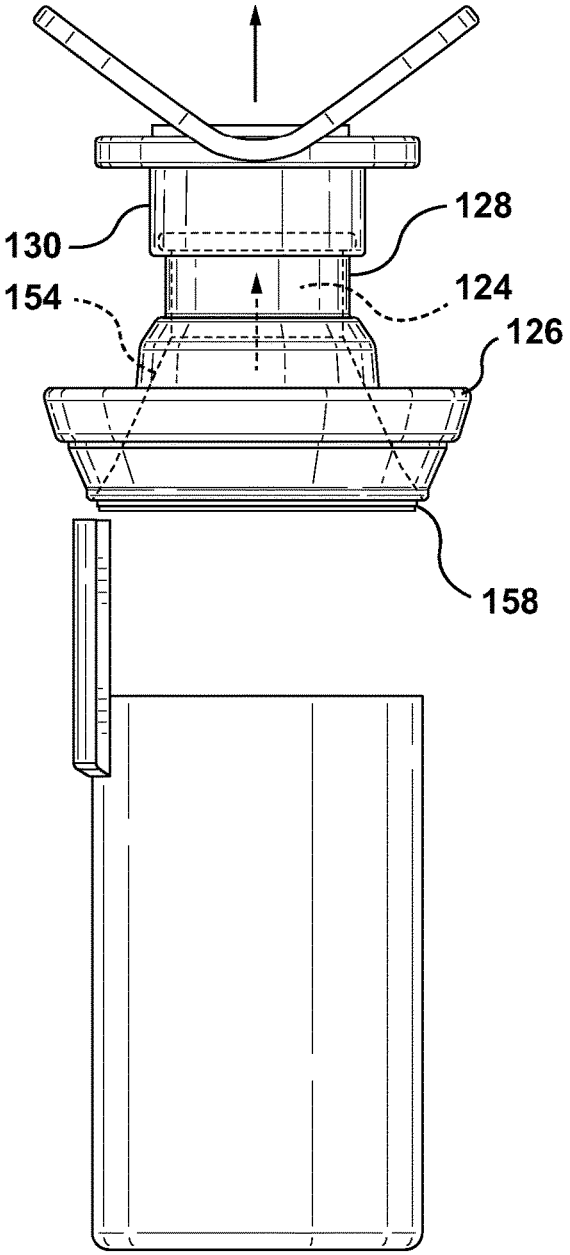
FIG. 20 is a left side view of the catalyst container and spout assembly with the spout assembly and a top member of the catalyst container separated from a reservoir of the catalyst container.
Figure 23:
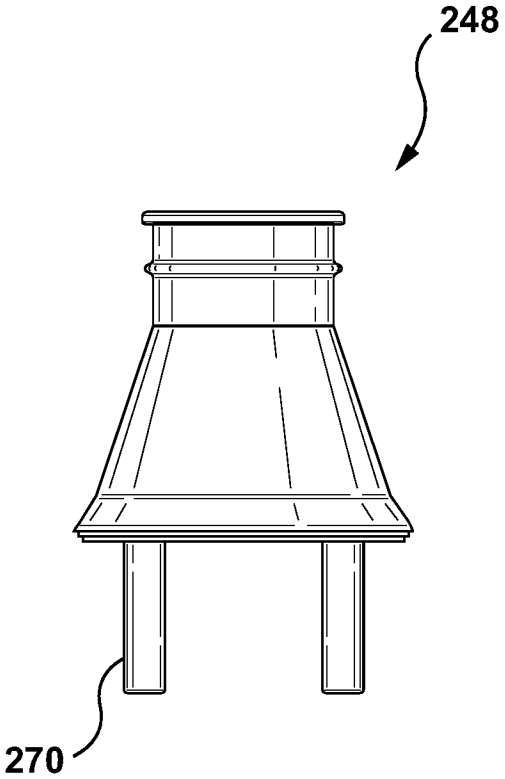
FIG. 23 is a rear view of the catalyst container.
Figure 22:
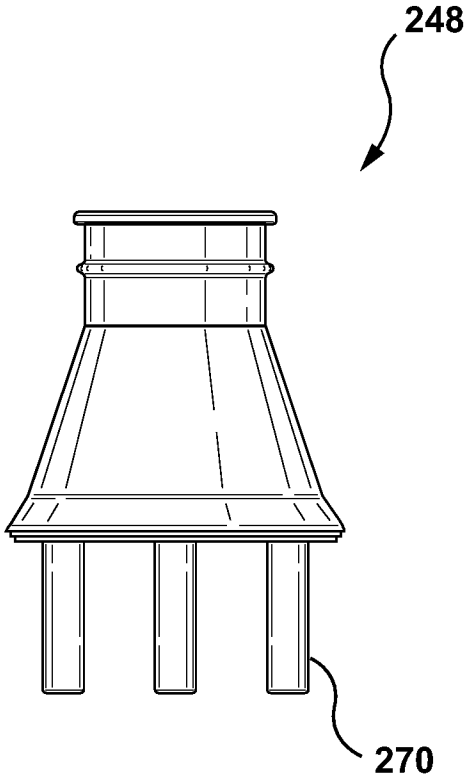
FIG. 22 is a left side view of the catalyst container.
Figure 21:
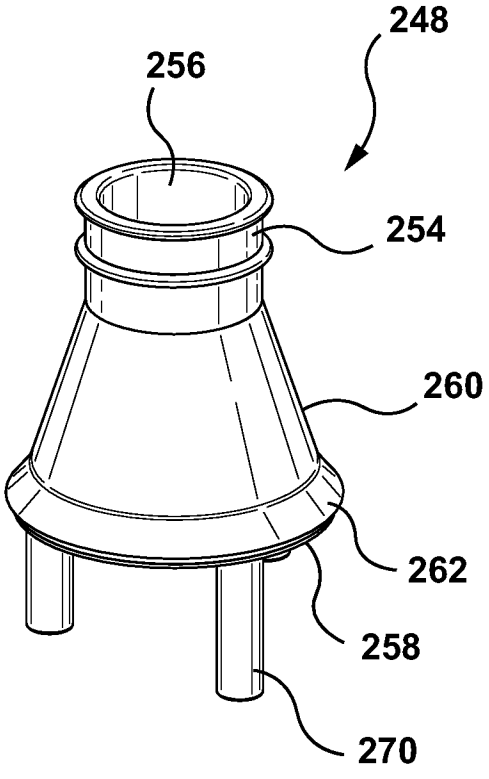
FIG. 21 is a perspective view of a top member of a catalyst container.
Figure 24:
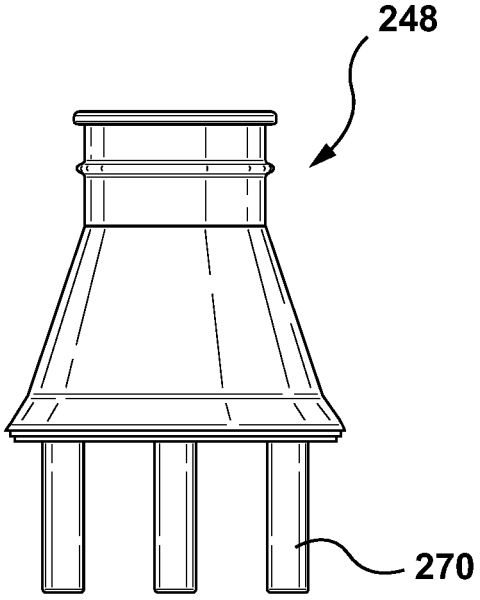
FIG. 24 is a right side view of the catalyst container.
Figure 25:
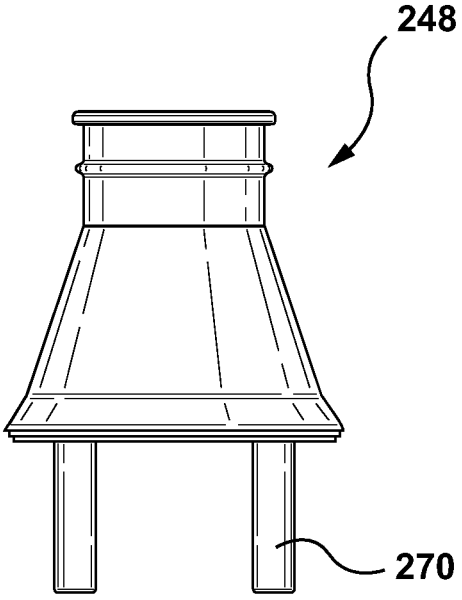
FIG. 25 is a front view of the catalyst container.
Figure 26:
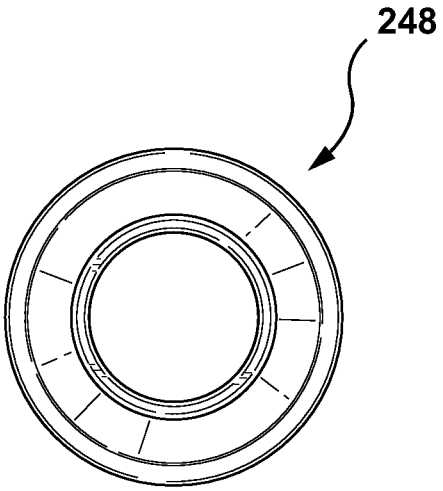
FIG. 26 is a top view of the catalyst container.
Figure 27:
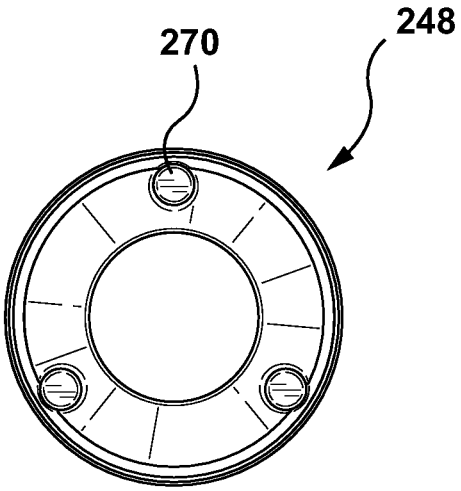
FIG. 27 is a bottom view of the catalyst container.
Figure 30:
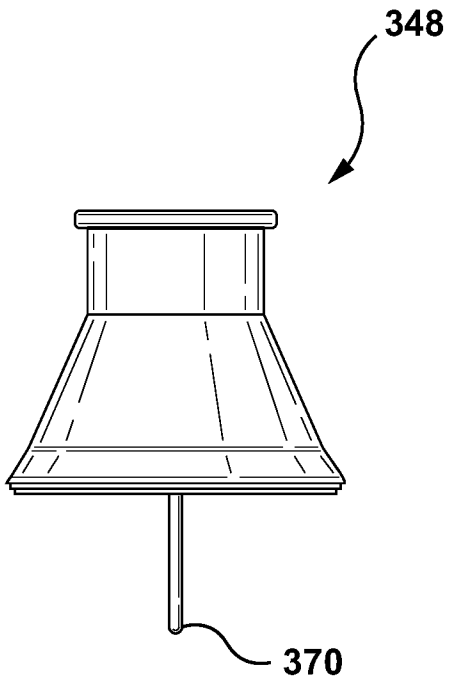
FIG. 30 is a rear view of the catalyst container.
Figure 29:
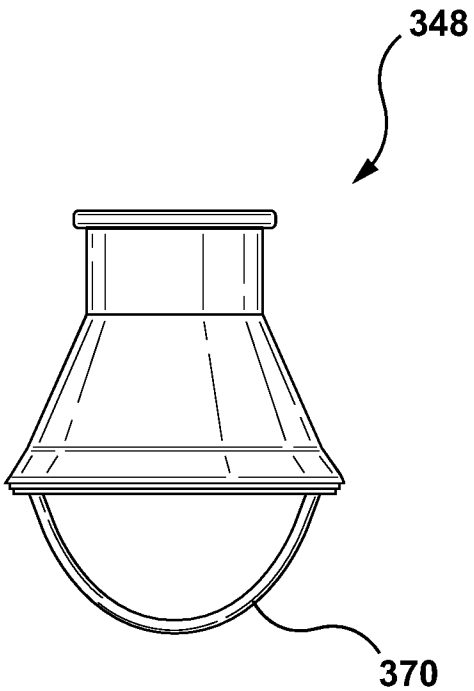
FIG. 29 is a left side view of the catalyst container.
Figure 28:
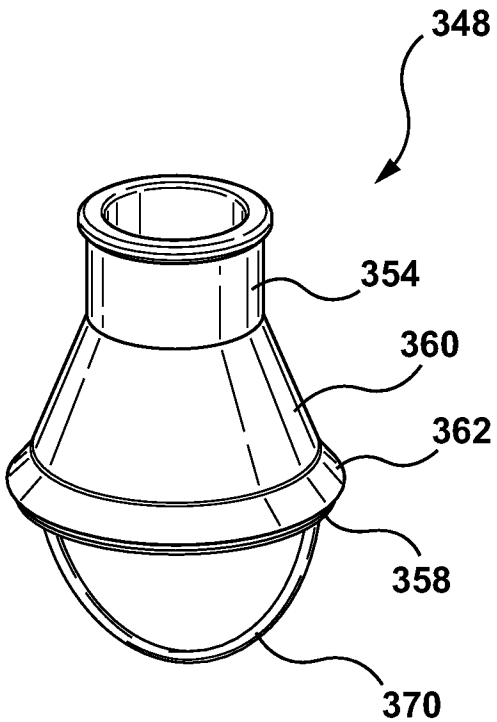
FIG. 28 is a perspective view of a top member of another catalyst container.
Figure 31:
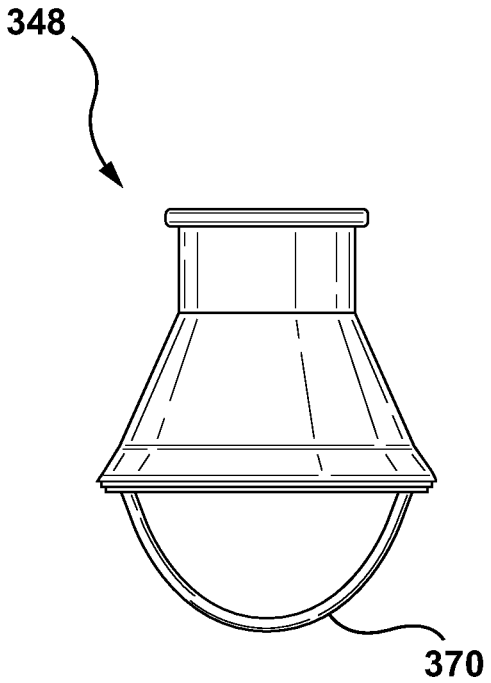
FIG. 31 is a right side view of the catalyst container.
Figure 32:
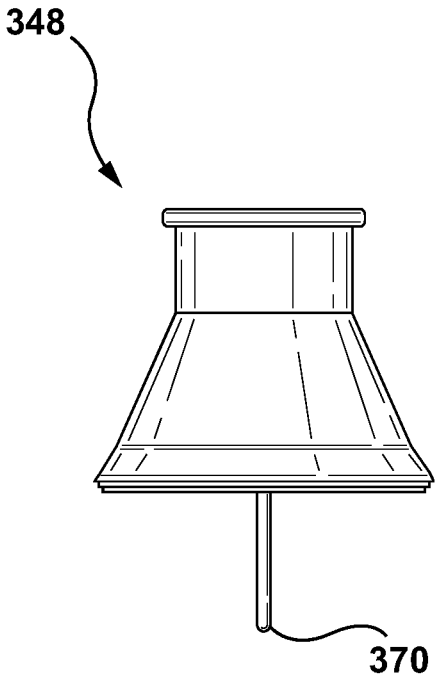
FIG. 32 is a front view of the catalyst container.
Figure 33:
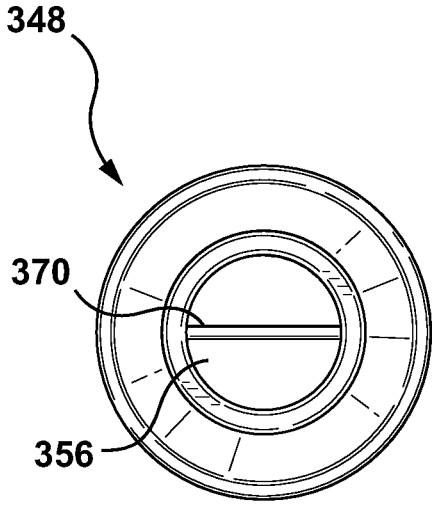
FIG. 33 is a top view of the catalyst container.
Figure 34:
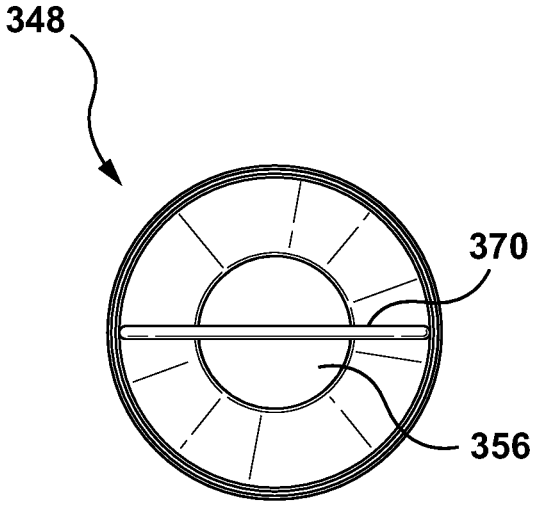
FIG. 34 is a bottom view of the catalyst container.
Figure 35:
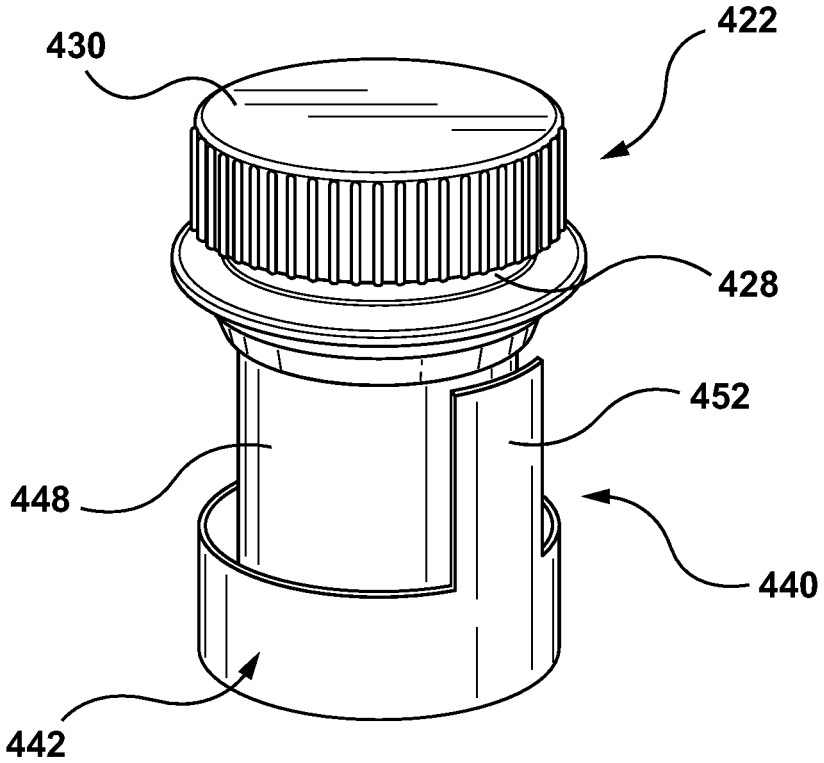
FIG. 35 is a top perspective view of another embodiment of a catalyst container and spout assembly.
Figure 36:
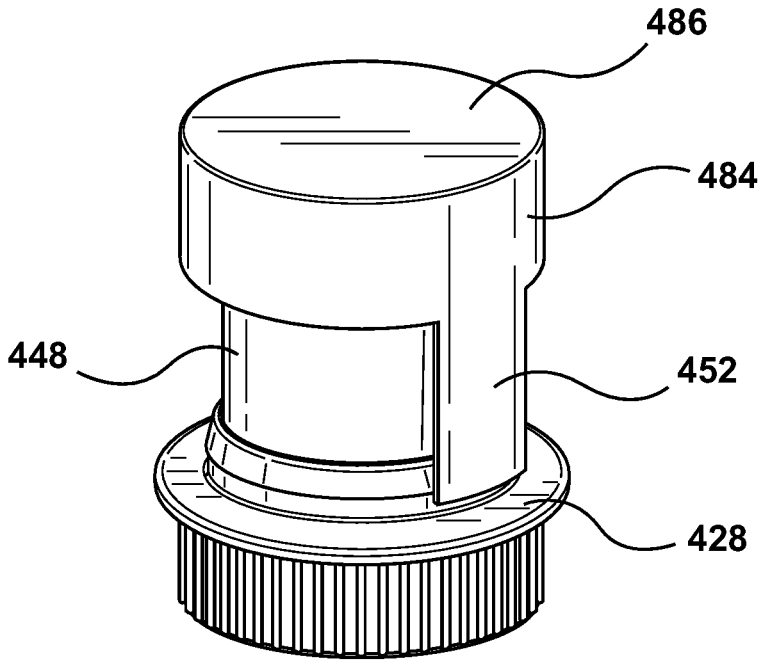
FIG. 36 a bottom perspective view of the catalyst container and spout assembly.
Figure 37:
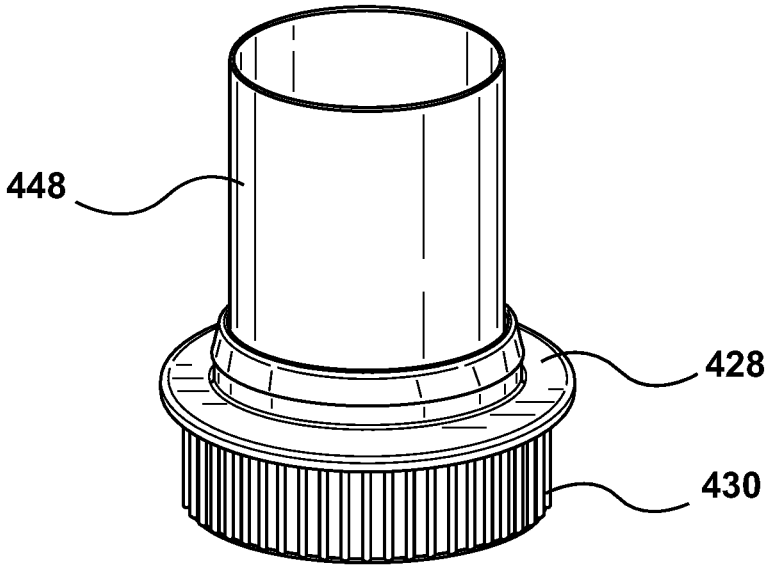
FIG. 37 is a bottom perspective view of the catalyst container and the spout assembly with a reservoir of the catalyst container removed.
Figure 38:
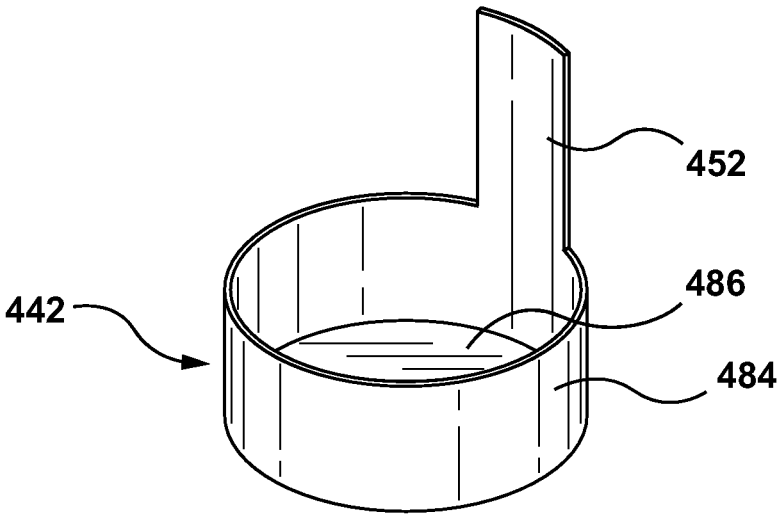
FIG. 38 is a perspective view of the reservoir.

Referring additionally to FIGS. 19 and 20, the spout assembly 122 is a flexible spout assembly formed of a suitable material, such as plastic. The spout assembly 122 includes a body 126 secured to a lid of a container, a first spout 128 extending from the body 126 and movable between a closed position shown in FIG. 19 and an open position shown in FIG. 20 and defining the through passage 124, and a cap 130 removably secured to the spout 128. The cap 130 may include one or more gripping devices 132 for a user to grasp and may be covered by a tamper resistant seal. Additionally or alternatively, the spout 128 can be closed by a tamper resistant seal that is removed prior to pouring, spraying, or pumping coating material out of the spout 128.

The second spout 154 is designed to couple to the first spout 128 in a suitable manner, such as by a pressure fit, threaded connection, adhesive, molding, etc., and as shown is partially disposed within the first spout 124. The second spout 154 includes one or more circumferentially extending ribs 164 extending radially outward from an outer surface of the second spout 154 that abut an inner surface of the first spout 128 to create the pressure fit. In the illustrated embodiment, the second spout 152 extends upward a first distance and the spacer 152 extends upward a second distance less than the first distance such that the second spout 154 extends further from a bottom of the catalyst container 140 than the spacer 152.

When the first spout 128 is in the closed position and the top member 148 is secured to the reservoir 142, a top of the spacer 152 abuts an underside of the lid or a bottom of the body 126, serving as a stop to prevent upward movement of the reservoir 142. In this position, the catalyst is stored within the reservoir 142 to prevent mixing with the coating material until desired by a user. When the first spout 128 is moved to the open position, the top member 148 is moved upward with the first spout 128, while the spacer 152 prevents upward movement of the reservoir 142, and thereby the top member 148 is moved away from the reservoir 142 until the top member 148 separates from the reservoir 142.

When the top member 148 separates from the reservoir 142, the reservoir 142 drops into the container body causing the catalyst to mix with the coating material. The spacer 152 additionally serves to prevent the reservoir 142 from blocking the through passage 156 in the second spout 154 by preventing the top of the reservoir from coming into contact with the top member 148 when the first spout 128 is in the open position. In an embodiment, the reservoir 142 can be made of a material denser than the coating material causing the reservoir 142 to sink to a bottom of the container body. In an embodiment, the reservoir 142 may include one or more magnets that magnetize to the bottom of the container body to hold the reservoir 142 in position when the coating material is poured, sprayed, or pumped out of the storage container. Additionally or alternatively, a top of the reservoir 142 can be denser than a bottom of the reservoir 142.

To mix the coating material with the catalyst, the end user removes the tamper resistant seal. The end user then grasps the gripping devices 132 on the cap 130 and pulls upward away from the lid in a first direction until the first spout 128 is in the open position shown in FIG. 20. As the first spout 128 moves upward, the second spout 154 attached thereto moves upward with the first spout 128, thereby causing the reservoir 142, which is prevented from moving upward by the spacer 152, to separate from the top member 148. After separation of the top member 148 and the reservoir 142, the reservoir 142 moves downward away from the lid in a second direction opposite the first direction toward the bottom of the storage container causing the catalyst to disperse in the coating material. The end user can then shake or otherwise agitate the coating material to cause the catalyst to mix with the coating material. The top member 148 remains attached to the first spout 128 during movement of the first spout 128 between the open and closed positions unless removed by the end user.

Turning now to FIGS. 21-27, an exemplary embodiment of a top member of a catalyst container is shown at 248. The top member 248 is substantially the same as the above-referenced top member 148, and consequently the same reference numerals but indexed by 100 are used to denote structures corresponding to similar structures in the top members. In addition, the foregoing description of the top member 148 is equally applicable to the top member 248 except as noted below.

The top member 248 includes a second spout 254 defining a through passage 256 in communication with a through passage in a first spout of a container and extending upward from a conical body 260. The body 260 can have a lip 262 that contacts a top of the reservoir when secured thereto, and an area having an annular rib 258 that is disposed within the second chamber when the top member 248 is secured to the reservoir and that engages with an inner surface of the reservoir. The body 260 can also include one or more extensions, such as one or more legs 270 extending downward from the conical body 260, and in the illustrated embodiment three legs 270. The legs 270 are sized to fit within the reservoir when the top member 248 and reservoir are attached, and are designed to assist in preventing the reservoir from blocking the through passage 256 in the second spout 254 by preventing the top of the reservoir from coming into contact with the top member 248 when the first spout is in the open position.

Turning now to FIGS. 28-34, an exemplary embodiment of a top member of a catalyst container is shown at 348. The top member 348 is substantially the same as the above-referenced top member 148, and consequently the same reference numerals but indexed by 200 are used to denote structures corresponding to similar structures in the top members. In addition, the foregoing description of the top member 148 is equally applicable to the top member 348 except as noted below.

The top member 348 includes a second spout 354 defining a through passage 356 in communication with a through passage in a first spout of a container and extending upward from a conical body 360. The body 360 can have a lip 362 that contacts a top of the reservoir when secured thereto, and an area having an annular rib 358 that is disposed within the second chamber when the top member 348 is secured to the reservoir and that engages with an inner surface of the reservoir. The body 360 can also include one or more extensions, such as bail 370 having first and second ends attached to the body 360 and extending downward from the conical body 360. The bail 370 is sized to fit within the reservoir when the top member 348 and reservoir are attached, and are designed to assist in preventing the reservoir from blocking the through passage 356 in the second spout 354 by preventing the top of the reservoir from coming into contact with the top member 348 when the first spout is in the open position.

Turning now to FIGS. 35-39, an exemplary embodiment of the catalyst container is shown at 440 and the spout assembly is shown at 422. The catalyst container 440 and spout assembly 422 are substantially the same as the above-referenced catalyst container 40 and spout assembly 22, and consequently the same reference numerals but indexed by 400 are used to denote structures corresponding to similar structures in the catalyst container and spout assembly. In addition, the foregoing description of the catalyst container 40 and spout assembly 22 is equally applicable to the catalyst container 440 and spout assembly 422 except as noted below.

The spout assembly 422 includes a spout 428 secured to a lid of a container or integrally formed therewith and defining a through passage 424, and a cap 430 removably secured to the spout 428. The spout 428 can be closed by a seal 480 that is removed prior to pouring, spraying, or pumping coating material out of the spout 428. The seal 480 may be a tamper resistant seal that is torn away, twisted off, etc., that has a portion 482 for a user to grasp to remove the seal 480.

The catalyst container 440 includes a reservoir 442 and a top member 448 that with the reservoir 442 defines a second chamber for holding a catalyst. The top member 448 is removably secured to the reservoir 442. The reservoir 442 includes a body 484, a bottom portion 486, and one or more spacers or arms 452 extending upward from a top of the body 484. The body 484 and bottom portion 486 define a space for receiving the top member 448, and the top member 448 is a substantially cylindrical member having a diameter less than a diameter of the through passage 424 of the spout 428. In an embodiment, the reservoir includes the bottom portion and the one or more spacers extending upward from the bottom portion, and the top member is removably attached in a suitable manner to the bottom portion. The top member 448 can include a sidewall, wherein the sidewall extends from a top portion that couples to the seal 480 to a bottom portion that couples to the reservoir 442. The sidewall can be, but not limited to, perpendicular (as shown) between the top portion and the bottom portion, tapered outward, tapered inward, among others. It is to be appreciated that the configuration or orientation of the sidewall between the top portion and the bottom portion can be selected with sound engineering judgment without departing from the scope of this innovation.

Figure 39:
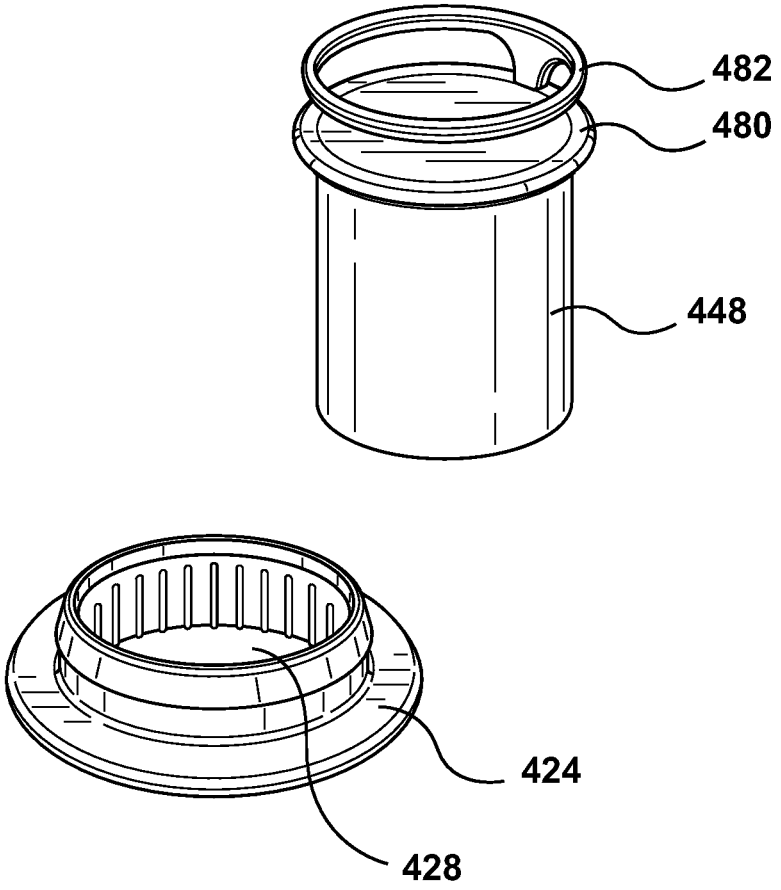
FIG. 39 is a perspective view of a spout and seal of the spout assembly and a top member of the catalyst container.
Figure 40:
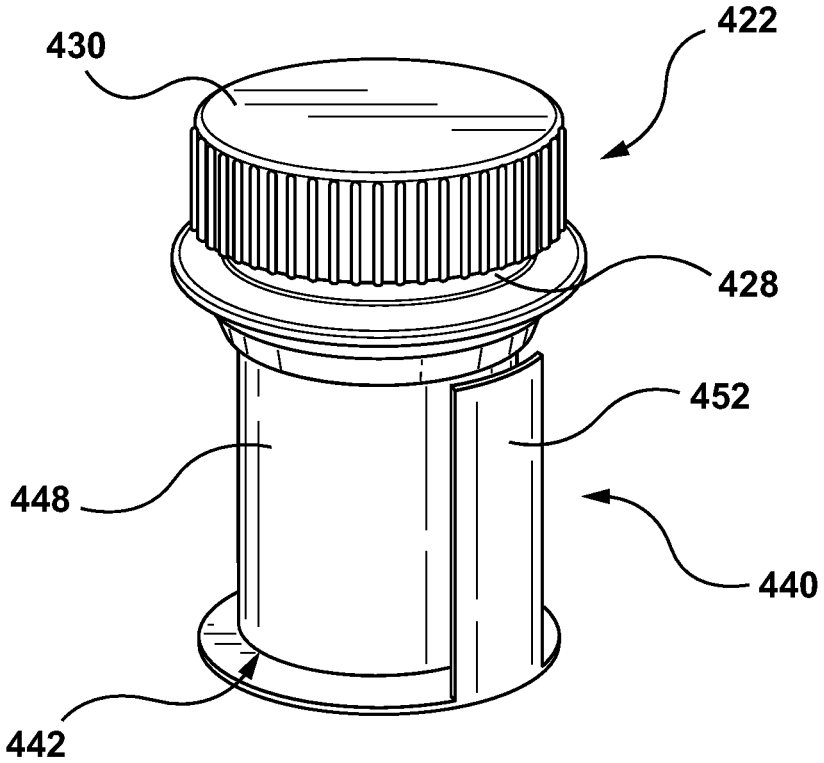
FIG. 40 is a top perspective view of another embodiment of a catalyst container and spout assembly.
Figure 41:
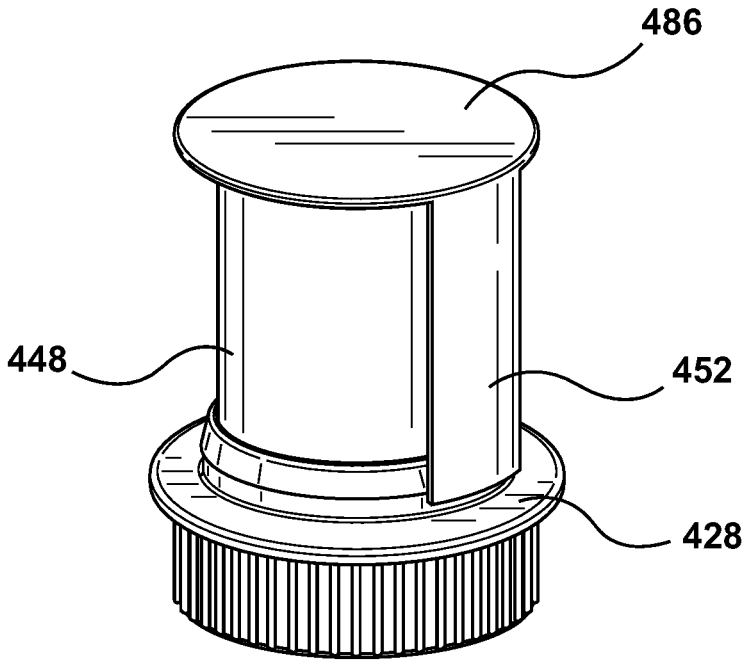
FIG. 41 a bottom perspective view of the catalyst container and spout assembly.
Figure 42:
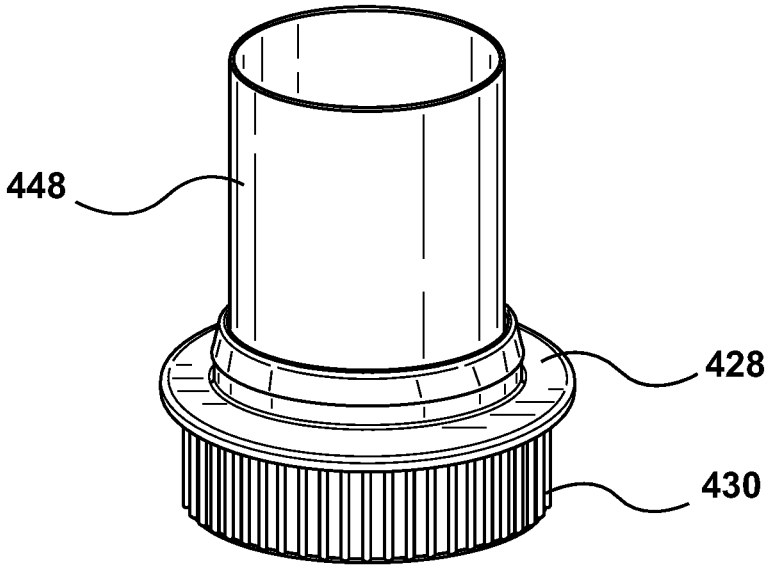
FIG. 42 is a bottom perspective view of the catalyst container and the spout assembly with a bottom cap of the catalyst container removed.
Figure 43:
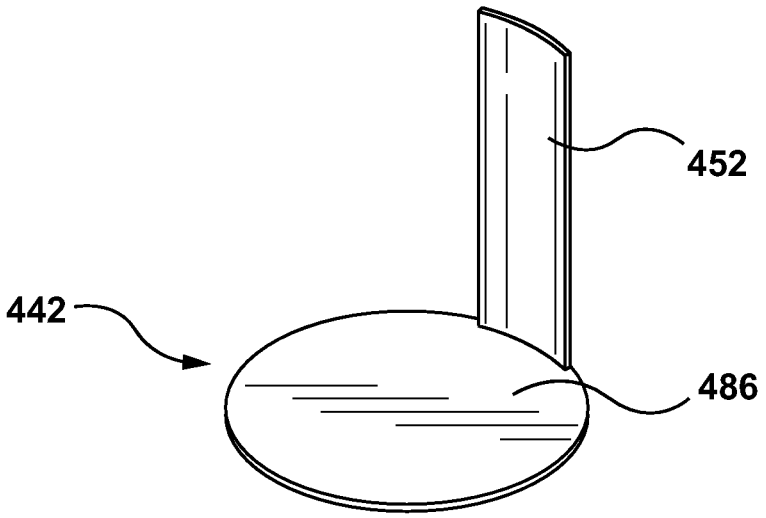
FIG. 43 is a perspective view of the bottom cap.

The top member 448 is attached to the seal 480 as shown in FIG. 39 such that when the seal 480 is separated from the spout 428 and removed, the top member 448 is removed as well. The top member 448 may be attached to the seal 480 in any suitable manner or may be integrally formed with the seal, for example molded as a single piece.

When the seal 480 is secured to the spout 428, a top of the spacer 452 abuts or is adjacent to an underside of the lid of the container or a bottom of the spout 428. In this position, the catalyst is stored within the reservoir 442 and top member 448 to prevent mixing with the coating material until desired by a user. When the seal 480 is separated from the spout 428 and moved away from the container, the top member 448 is moved away with the seal 480 while the spacer 452 prevents upward movement of the reservoir 442, and thereby the top member 448 is moved away from the reservoir 442 until the top member 448 separates from the reservoir 442. The seal 480 and top member 448 may then be disposed.

When the top member 448 separates from the reservoir 442, the reservoir 442 drops into the container body causing the catalyst to mix with the coating material. The spacer 452 additionally serves to prevent the reservoir 442 from blocking the through passage 424 in the spout 428. In an embodiment, the reservoir 442 can be made of a material denser than the coating material causing the reservoir 442 to sink to a bottom of the container body. In an embodiment, the reservoir 442 may include one or more magnets that magnetize to the bottom of the container body to hold the reservoir 442 in position when the coating material is poured, sprayed, or pumped out of the storage container. Additionally or alternatively, a top of the reservoir 442 can be denser than a bottom of the reservoir 442.

In another embodiment illustrated in FIGS. 40-43, an exemplary embodiment of the catalyst container is shown at 440 and the spout assembly is shown at 422. The catalyst container 440 includes a bottom cap 442 (referenced in other Figures as reservoir 442) and a top member 448 that with the bottom cap 442 defines a chamber for holding a catalyst. The top member 448 is removably secured to the bottom cap 442. The bottom cap 442 includes a bottom portion 486, and one or more spacers or arms 452 extending upward from the bottom portion 486. The bottom portion 486 can be removably coupled to the top member 448, and the top member 448 is a substantially cylindrical member having a diameter less than a diameter of the through passage 424 of the spout 428. In an embodiment, the bottom cap 442 includes the bottom portion 486 and the one or more spacers extending upward from the bottom portion 486, and the top member 448 is removably attached in a suitable manner to the bottom cap 442.

The top member 448 is attached to the seal 480 such that when the seal 480 is separated from the spout 428 and removed, the top member 448 is attached to the seal and removed from the spout 428 as well. The top member 448 may be attached to the seal 480 in any suitable manner or may be integrally formed with the seal, for example molded as a single piece.

When the seal 480 is secured to the spout 428, a top of the spacer 452 abuts or is adjacent to an underside of the lid of the container or a bottom of the spout 428. In this position, the catalyst is stored within the chamber created by the bottom cap 442 and top member 448 to prevent mixing with the coating material until desired by a user. When the seal 480 is separated from the spout 428 and moved away from the container, the top member 448 is moved away with the seal 480 while the spacer 452 prevents upward movement of the cap bottom 442, and thereby the top member 448 is moved away from the cap bottom 442 until the top member 448 separates from the cap bottom 442. The seal 480 and top member 448 may then be disposed.

When the top member 448 separates from the cap bottom 442, the cap bottom 442 is removed allowing the catalyst to drop into the container body causing the catalyst to mix with the coating material. The spacer 452 additionally serves to prevent the cap bottom 442 from blocking the through passage 424 in the spout 428. In an embodiment, the cap bottom 442 can be made of a material denser than the coating material causing the cap bottom 442 to sink to a bottom of the container body. In an embodiment, the cap bottom 442 may include one or more magnets that magnetize to the bottom of the container body to hold the cap bottom 442 in position when the coating material is poured, sprayed, or pumped out of the storage container. Additionally or alternatively, a portion of the cap bottom 442 can be denser than another portion of the cap bottom 442 to encourage the cap bottom 442 to position to the bottom of the container.

In another embodiment of the catalyst container, the container is a breakable sealed container, such as a blister pack, that hold the catalyst and disperses the catalyst when broken. For example, the sealed container may be broken in a suitable manner when the cap is opened and seal removed causing the catalyst to be automatically dispersed in the container. Alternatively, the sealed container could be ruptured upon an action by a user, such as by a tool.

The aforementioned elements (e.g., top members, reservoirs, among others), and the like have been described with respect to interaction between several components and/or elements. It should be appreciated that such elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the subject matter, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A container assembly including:

a storage container including:

a container body defining a first chamber for holding a first material; and a lid assembly including a lid removably or nonremovably secured to the container body and a first spout secured to the lid and defining a through passage in communication with the first chamber; and a catalyst container including:

a reservoir defining a second chamber for holding a second material, the reservoir having a spacer extending therefrom; and a top member removably secured to the reservoir to close the second chamber, the top member having a second spout secured to the first spout and defining a through passage in communication with the through passage of the first spout, wherein the first spout is movable between a closed position and an open position, wherein when the first spout is in the closed position, the spacer abuts an underside of the lid or an underside of the first spout and the top member is attached to the reservoir, and wherein when the first spout is in the open position , the top member is moved away from and separated from the reservoir causing the reservoir to release the second material into the first chamber and to mix with the first material.

2. The container assembly according to claim 1, wherein the top member includes a planar body and the second spout extends upward from the planar body perpendicular to the planar body.

3. The container assembly according to claim 2, wherein the planar body includes a lip that contacts a top of the reservoir when secured thereto, and a sealing area disposed within the second chamber.

4. The container assembly according to claim 3, wherein the sealing area includes a seal groove, and the catalyst container further includes a seal disposed in the seal groove to seal the top member to the reservoir.

5. The container assembly according to claim 1, wherein the top member includes one or more extensions extending therefrom for preventing the reservoir from blocking the through passage of the second spout after separation.

6. The container assembly according to claim 5, wherein the one or more extensions extends downward from the top member and disposed within the second chamber when the top member and reservoir are secured to one another.

7. The container assembly according to claim 5, wherein the one or more extensions includes a plurality of extensions extending in a direction substantially parallel to a longitudinal axis of the top member.

8. The container assembly according to claim 5, wherein the one or more extensions includes a bail having first and second ends attached to the body.

9. The container assembly according to claim 1, wherein the second spout includes one or more circumferentially extending ribs extending radially outward from an outer surface of the second spout that abut an inner surface of the first spout.

10. The container assembly according to claim 1, wherein the second spout includes a first portion having a first diameter and a second portion at a bottom of the second spout having a second diameter less than the first diameter.

11. The container assembly according to claim 10, wherein the first spout includes a plurality of circumferentially spaced fins, wherein when the first spout moves to the open position, the fins move inward and surround the second spout at the second portion.

12. A container assembly including:

a storage container including:

a container body defining a first chamber for holding a coating material; and a lid assembly including a lid removably or nonremovably secured to the container body and a first spout secured to the lid; and a catalyst container including:

a reservoir defining a second chamber for holding a second material, the reservoir having a spacer extending therefrom for abutting the lid or first spout; and a top member removably secured to the reservoir, the top member having a second spout secured to the first spout of the lid assembly.

13. The container assembly according to claim 12, wherein the spacer abuts an underside of the lid or an underside of the first spout and the top member is attached to the reservoir when the first spout is in a first position, and the top member is moved away from and separated from the reservoir causing the reservoir to drop into the first chamber when the first spout is in a second position.

14. The container assembly according to claim 12, wherein the top member includes one or more extensions extending therefrom for preventing the reservoir from blocking the second spout when the top member and reservoir are not secured to one another.

15. The container assembly according to claim 14, wherein the one or more extensions extends downward from the top member and disposed within the second chamber when the top member and reservoir are secured to one another.

16. The container assembly according to claim 14, wherein the one or more extensions includes a plurality of extensions extending in a direction substantially parallel to a longitudinal axis of the top member.

17. The container assembly according to claim 12, wherein the second spout extends upward a first distance and the spacer extends upward a second distance greater than the first distance such that the spacer extends further from a bottom of the catalyst container than the second spout.

18. The container assembly according to claim 12, wherein the second spout extends upward a first distance and the spacer extends upward a second distance less than the first distance such that the second spout extends further from a bottom of the catalyst container than the spacer.

19. A method of catalyzing a coating material in a storage container, the storage container including a container body defining a first chamber and a lid assembly including a lid removably or nonremovably secured to the container body and a first spout secured to the lid, and a catalyst container including a reservoir defining a second chamber for holding a second material and a top member removably secured to the reservoir, the top member having a second spout secured to the first spout, the method including:

moving the first spout from a closed position to an open position thereby moving the top member away from the reservoir and separating the reservoir from the top member whereby the second material is released into the first chamber for mixing with the first material.

20. The method of claim 19, wherein the reservoir includes a spacer extending from the reservoir, and wherein during moving of the first spout, the spacer abuts an underside of the lid and prevents movement of the reservoir during movement of the top member and first spout.

* * * * *